United States Patent [19]

Friedman

[11] Patent Number: 4,863,194

[45] Date of Patent: Sep. 5, 1989

[54] INDEXING SYSTEMS

[76] Inventor: Michael N. Friedman, 7 Harbor Ct., Centerport, N.Y. 11721

[21] Appl. No.: 201,079

[22] Filed: Jun. 1, 1988

[51] Int. Cl.[4] ..... B42F 21/00; B42F 21/04; B42F 21/02; G09F 19/00

[52] U.S. Cl. ..... 283/38; 283/42; 40/360; 40/530

[58] Field of Search ..... 283/37, 38, 39, 40, 283/42; 40/360, 371, 530

[56] References Cited

U.S. PATENT DOCUMENTS

| | | | |
|---|---|---|---|
| 191,885 | 6/1877 | Roberts | 283/39 |
| 533,811 | 2/1895 | Hon | 283/38 |
| 1,474,663 | 11/1923 | Coe | 283/42 |
| 4,364,586 | 12/1982 | Ott | 40/360 |
| 4,458,435 | 7/1984 | Ackerman | 40/530 |
| 4,516,871 | 5/1985 | Leitman | 283/38 |

FOREIGN PATENT DOCUMENTS

| | | | |
|---|---|---|---|
| 696823 | 10/1965 | Italy | 283/36 |

*Primary Examiner*—Frank T. Yost
*Assistant Examiner*—Paul M. Heyrana, Sr.
*Attorney, Agent, or Firm*—Bauer & Schaffer

[57] ABSTRACT

An indexing system made of a plurality of arranged index sheets, each provided with indicia such as a letter, color, or symbol on an extended area thereof and a plurality of holes so that when the sheets are arranged one on the other, a viewer can see the specific indicia through the holes.

10 Claims, 1 Drawing Sheet

INDEXING SYSTEMS

BACKGROUND OF THE INVENTION

This invention relates to a system for indexing books such as appointment books, notebooks, address books, or the like, and in particular to an arrangement wherein indexing sheets are interspersed in a predetermined arrangement between the pages of the book to provide a sequential division of the pages.

A wide variety of books, not only appointment books, notebooks, and address books, but also dictionaries, directories, and the like, employ indexing means to facilitate the use and retrieval of the information contained on the pages of the book. Such system includes tabs secured by adhesive to the selected pages of the book, inserted index sheets having extending tabs, sequential notching formed in the edges of the book, and the like. However, most of the known systems are somewhat complex in structure and somewhat inflexible in use as well as requiring relatively complex manufacturing steps for making and assembling them in combination with the book itself. There exists, therefore, a need for an indexing system which provides greater flexibility in use in final product form such as in diaries, notebooks, and the like and which can be manufactured by relatively simple and straight forward processes and assembly steps.

A significant need exists for the production of index sheets which are relatively strong, resisting tearing, twisting, and destruction. The present invention fulfils such needs.

Other objects and advantages will be apparent from the following disclosure of the present invention.

BRIEF STATEMENT OF THE INVENTION

In accordance with the present invention, in its broadest aspects, there is provided an indexing system comprising a plurality of index sheets, each of which has an extended area along a lateral margin common with the other sheets of the plurality provided with selected indicia for collective arrangement in a coordinated system. The margins are devisable into a plurality of uniformly-spaced sections along their length and have a predetermined section adapted to receive an alpha-numeric or other symbol while the remaining sections are provided with apertures. The predetermined sections are offset from each other along the length of the margin so that when the plurality of sheets are stacked into a set, each of the sections for indicia are visible through the holes.

In a particular form the common margins are alphabetically coordinated in that in uniformly-spaced sections of the common margin extending from the top to bottom of the sheets, the first sheet of the set of sheets has the letter "A" disposed in the top section and a plurality of holes located below in each of the other sections, while each of the subsequent consecutive sheets in the set are consecutively provided with letters "B" through "Z" disposed respectively in sequentially descending and consecutively succeeding sections. The sections not provided with a letter are themselves provided with a hole of comparable size to the letter so that when all of the sheets in the set are assembled into a set, the holes are in registry, and the letters descend uniformly. Thus, in a book such as in diary, notebook, or the like, where the sheets are interspersed in the known and conventional way with the conventional pages of the book, the common lateral margin will extend beyond the edges of the associated pages, with the sequence of holes from top to bottom in each of the index sheets in registry. As a result each of the letters, in the consequently-spaced index sheets is visible to the user through the holes formed in the other sheets.

According to the present invention a simple and improved method of forming the index sheets is provided comprising the steps of providing a set of index sheets having a common marginal extension along one edge, providing sequential indicia such as the alphabet in consecutive uniformly-spaced sections along the edge thereof and removing aperture spaces or holes in those sections other than the specific indicia selected to provide a set of index sheets having in consecutive order the sequential indicia, one by one. The present method is preferably carried out by simply printing all the index sheets, bearing one of the sequence of indicia at a time and punching the holes all the commonly printed sheets at once and thereafter collating the sheets with appropriate sets of sequential index sheets.

Full details of the present invention are set forth in the following description of an exemplary embodiment of the invention.

THE DRAWINGS

In order to describe the inventive system, products incorporating the same, and process for the manufacture thereof, reference is directed to the accompanying drawings in which:

FIG. 1 is a plan view of the indexing system of the invention, assembled with a cover therefor and illustrating the disposition of the letters of the alphabet and holes in the extended areas of the plurality of sheets so that all of the letters of the alphabet are visible to a viewer when the plurality of index sheets are disposed in alphabetical order with respect to each other;

FIG. 2 in a partial sectional view in perspective of the index system illustrated in FIG. 1 showing the disposition of the several index sheets provided with the letters "A", "B", and "C" and the interleaved disposition therewith of a plurality of sheets for recording intelligence;

DESCRIPTION OF THE PREFERRED EMBODIMENTS

Figure 1:
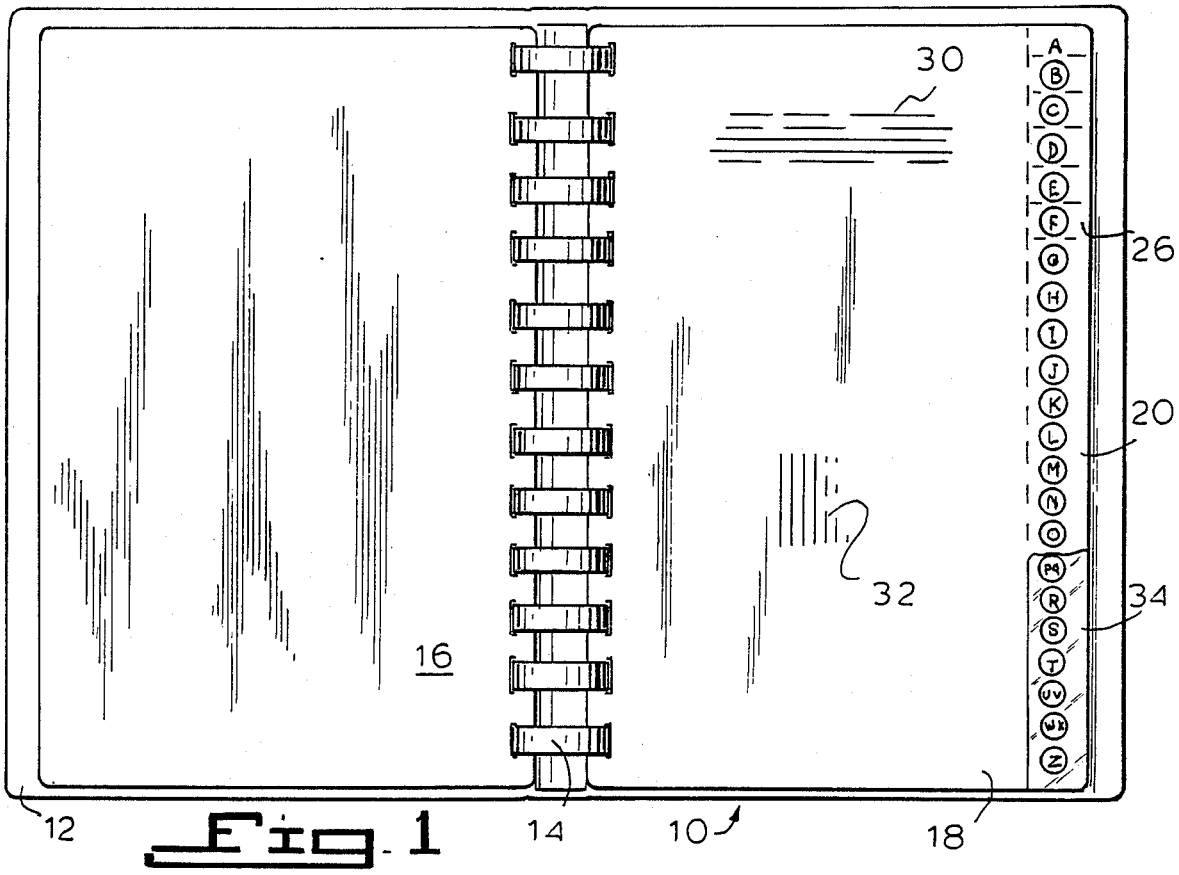

In the following description the present invention is described in connection with the formation of a telephone/address book having a special ring binder for assembling and replacing pages. It is to be understood that the invention is applicable in its application to permanently bound books, ring binders, and other book forms, and may even be provided in the form of a set of index sheets for replacement and/or retro-fitting of existing books. Further, in defining the index sheets of the present invention the term sheet is to be taken in its broadest sense as meaning paper sheet, card stock, oaktag, plastic sheet, cardboard sheet, and the like on which indicia can be applied as by printing, adhesive labeling, embossing, or the like and wherein the sheet can be punched or otherwise provided with holes.

Turning now to the Figures, a book, generally indicated by the numeral 10, is provided, comprising an outer cover 12 and a helical spine 14 on which are loosely attached a plurality of sheet pages 16 which are preprinted and/or on which the user can write, paint, or otherwise apply his own information.

Interspersed between selected numbers of pages 16 are a series of index sheets 18 attached to the spine in the same manner as pages 16. Each of the index sheets 18 has an extending common lateral margin 20 (defined by the vertical broken line), extending outwardly beyond the direction of the pages 16 and which is provided in selected manner with indicia 22 and holes 24. To accomodate the indicia 22 and holes 24 and to insure registration of the indicia and holes in successive index sheets (as will be described later) the margin is broken, in an imaginary manner, into a series of uniform horizontal spaces defined by the horizontal dotted lines 26. By centering the printing of the indicia 22 and the holes 24 at the center of the space 26, all of the index sheets will have indicia and holes in registry.

Figure 2:
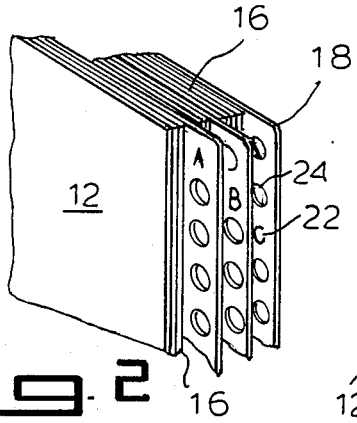
Figure 3:
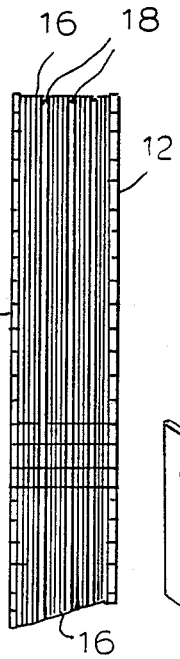
FIG. 3 is a partial view in elevation of the leading edge of the book incorporating the index system illustrated in FIG. 1 with the covers closed.

In the illustration of the book 10 shown in the figures, the index sheets 18 are collectively provided with a sequence of alphabetic letters "A" through "Z", with "A" by convention being the first and "Z" being the last in the book. As may be seen in detail from FIGS. 1 and 2, the letter "A" is disposed by printing or in any other conventional manner such as by attaching a decal to the top space of the extended lateral margin of the first index sheet 18 and forming a plurality of holes 24 in each of the spaces 26 below the letter "A". The holes may be punched, stamped, or otherwise formed in conventional manner to have a diameter sufficient to allow any letter or indicia underneath to be easily visible. The number of holes 24 formed are equal in number to the remaining letters of the alphabet.

The next index sheet 18 in the sequence has the letter "B" disposed thereon in the second space 26 from the top (i.e., just below the space for letter "A") and each of the remaining spaces, including that assumedly for the letter "A", is provided with a hole 24. The third index sheet in the series is provided with the letter "C" in the third space 26, sequentially below that of the spaces 26 normally used for the letters "A" and "B", and all the remaining spaces above and below it have holes 22. In similar fashion, each of the remaining index sheets 18 are formed with a letter "D" through "Z" and spaces above and below the given letter with holes 24, until the alphabet is exhausted. Since, as a practical matter, some letters are not frequently used in proper names, doubling up of letters in certain spaces 26 can be made. For example, the letters "X", "Y", and "Z" are normally used in singular combination in telephone directories or books.

Figure 4:
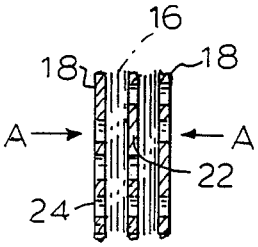
FIG. 4 is a partial sectional view in elevation of the leading edge of the arrangement illustrated in FIG. 2 showing the dispostional relationship of the index sheets bearing letters "A", "B", and "C" and the interleaved sheets for recording intelligence.
Figure 5:
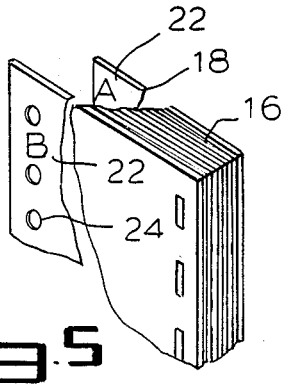
FIG. 5 is a view similar to that of FIG. 2 taken from the rear of the book.

A complete set of index sheets 18 are sequentially arranged as indicated earlier with the alphabet progressing from top to bottom. In this manner, the alphabet is visible to a viewer when the plurality of index sheets are placed in the book. If desired, the respective letters "A" through "Z" may be affixed to both sides of the respective index sheets 18, thus being viewable ahead and preceding any position to which a book containing the sheets is opened as seen by the arrows A in FIG. 4 and the view from the rear as in FIG. 5. Still further, the index sheets may be provided with horizontal lines 30 or vertical lines 32 on one or both sides for recording of additional intelligence or data. Moreover, a clear plastic reinforcing strip 34 may be affixed in any convenient manner on the extended lateral margin 20 of some or each index sheet 18 as shown in partial broken form in FIG. 1. The strip 34 may also be provided with holes such as holes which register with the holes 24 in each index sheet 18 or may be left clear to be seen through. The strip 34 serves to strengthen the extended lateral areas as well as keeping them clean during use. When so used, it may be preferred that plastic strip 34 be adhered to the extended areas before making the holes.

It will be understood that the present invention can also be employed in a book, the pages of which are coextensive or correspondingly dimensioned with the size of the index sheets—that is, a book in which the marginal edge of the guide sheet does not extend beyond the marginal edge of the interleafed informational pages and the indicia lies within the perimeter of the pages. In this instance, each of the intervening pages between the guide sheets are formed with uniformly-spaced holes arranged so as to be in registry with the holes in the index sheets from one end of the marginal edge to the other. None of the imaginary sections in the intervening pages will bear indicia or be without holes. In this manner the sequence of indicia formed on the interspersed index sheets will be visible through the corresponding holes made in all of the pages.

While each set of consecutively sequentially marked index sheets, for example a set of alphabetical sheets, can be obtained by forming the index sheets one by one in the consecutive set. The present invention, however, lends itself to a simple and fast production process. In the novel process the index cards 18 are cut in blank from conventional card stock or sheet so that each has the lateral marginal extending edge 20. A selected batch of blanks is then initially printed with a given letter, and this batch is then simultaneously punched to form not only the holes but also the slots for the spiral or ring binder. Successive batches, each with its own letter, can be made and thereafter a specific set conventionally collated using automatic collating machine.

Similarly, the pages between the index sheets may be made in batch or singularly, using known techniques and machinery.

As indicated earlier, the present inventio permits many variations, not only in the nature of the book being assembled but also in the nature and style of the sheet material used. While the invention is particularly adapted to alphabetical indexing, it will be apparent that similar advantages can be obtained with numerical indexing, color indexing, and the like. The round holes shown can be replaced with square or polygonal holes.

In any event, a distinctive indexing system is provided by the present invention in a simple and economical fashion. By providing a laterally extending margin, the margin retains its integrity and strength even though severe and repeated manipulation.

Consequently, the foregoing description is to be taken as illustrative only and not limiting of the scope of the invention as set forth in the appended claims.

What is claimed is:

1. An indexing system for separating the pages of a book, notebook, address book, into a coordinate sequence of two or more groups, comprising a plurality of stacked index sheets of substantially the size of the pages of the book, each sheet having a lateral marginal edge in common with each other and extending beyond the corresponding edge of said pages, said marginal edges of each sheet being devisable along its length into a plurality of uniformly-spaced sections, a predetermined one of said sections in each sheet having indicia on at least one surface representative of an associated group in said corresponding sequence, the remaining sections in the marginal edge of each sheet having apertures therethrough, said predetermined one of said sections in each sheet being offset uniformly by a distance equal to at least one section from one sheet to another so that when said sheets are arranged in coordinated sequence, the apertures of all said sheets are in registry with each other respectively and the sections of each sheet having indicia are sequentially arranged and visible through the registered apertures in the other sheets from either side of said stack.

2. The system according to claim 1 wherein the topmost sheet of said stacked plurality of sheets is provided with indicia in the section at one end of said marginal edge and each successive sheet is provided with indicia in each successive section toward the opposite end of said marginal edge.

3. The system according to claim 1 wherein said apertures are round holes having a diameter larger than said indicia.

4. The system according to cliam 1 including a book having a plurality of pages, said indexing sheets being interspersed sheet for sheet between the pages of said book.

5. The system according to claim 1 wherein indicia is disposed on both sides of said predetermined section of each of said sheets.

6. An indexing system according to claim 1 wherein the first sheet of said plurality of index sheets has the letter "A" disposed at the top of the extended marginal area thereof and holes located below said letter "A" sufficient in number to accommodate the remaining letters of the alphabet and extending to the bottom of said extended marginal area, and the subsequent consecutive sheets of said plurality of index sheets have the letters "B" through "Z" disposed thereon respectively, each in the next consecutive section of said marginal edged below the letter "A" of said first sheet and having a sufficient number of holes located in the sections above and below the letter or letters located on each consecutive sheet so that all of the letters of the alphabet are visible to a viewer when said plurality of index sheets are disposed in alphabetical order.

7. The indexing system according to claim 6 wherein the letter "A" is disposed on both sides of the first sheet, and the letters "B" through "Z" are disposed on both sides of subsequent consecutive sheets.

8. The indexing system according to claim 1 including a clear plastic reinforcing strip disposed on the extended area of each sheet of the plurality of index sheets, said strip being provided with holes which register with the holes in each sheet of said plurality of sheets.

9. The indexing system according to claim 1 in the form of a diary, appointment book, notebook, or address book and wherein each sheet of the plurality of index sheets includes a plurality of openings along a lateral margin opposite the lateral margin bearing the extended area, the system also including a cover having front and back members attached to a spine provided with ring means for attaching said index sheets thereto by way of side openings and having a plurality of sheets without extended areas and having openings for attaching the same to said ring means for recording intelligence disposed between said index sheets.

10. In combination a book, notebook, address book, comprising a plurality of pages devisible into a coordinated sequence of two or more groups and an indexing system comprising a plurality of stacked index sheets of substantially the same dimensions as said pages, said stacked index sheets being interspersed between said pages to separate respective ones of said groups, each of said pages and said sheets having a lateral marginal edge in common with each other and devisable along the length thereof into a plurality of uniformly-spaced sections along, said index sheets having a predetermined one of said sections provided with selected indicia corresponding with the respective associated group, the remaining sections of said pages and said index sheets being provided with apertures, said predetermined one of said section in each sheet being offset uniformly by at least the distance of one section from one sheet to another so that when said sheets are arranged in coordinated sequence with said pages, said apertures in said pages and sheets are in registry with each other, and the sections in each sheet having indicia are sequentially arranged and visible through the registered apertures.

* * * * *